US010227984B2

(12) United States Patent
Koyama et al.

(10) Patent No.: US 10,227,984 B2
(45) Date of Patent: Mar. 12, 2019

(54) SCROLL COMPRESSOR

(71) Applicant: Mitsubishi Electric Corporation, Tokyo (JP)

(72) Inventors: Shuhei Koyama, Tokyo (JP); Takashi Ishigaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 171 days.

(21) Appl. No.: 15/320,373

(22) PCT Filed: Sep. 19, 2014

(86) PCT No.: PCT/JP2014/074927
§ 371 (c)(1),
(2) Date: Dec. 20, 2016

(87) PCT Pub. No.: WO2016/042673
PCT Pub. Date: Mar. 24, 2016

(65) Prior Publication Data
US 2017/0204861 A1 Jul. 20, 2017

(51) Int. Cl.
*F04C 29/00* (2006.01)
*F04C 29/12* (2006.01)
(Continued)

(52) U.S. Cl.
CPC ..... *F04C 29/12* (2013.01); *F04C 18/0215* (2013.01); *F04C 18/0261* (2013.01);
(Continued)

(58) Field of Classification Search
CPC .. F04C 29/0007; F04C 29/12; F04C 18/0246; F04C 15/06; F04C 18/0261; F04C 29/042
(Continued)

(56) References Cited

U.S. PATENT DOCUMENTS 4,673,340 A * 6/1987 Mabe ..... F04C 28/10 418/15
2010/0129240 A1* 5/2010 Shiibayashi ..... F04C 18/0215 417/410.5
(Continued)

FOREIGN PATENT DOCUMENTS

JP H11-107945 A 4/1999
JP 4265128 B2 2/2009
(Continued)

OTHER PUBLICATIONS

International Search Report of the International Searching Authority dated Jan. 6, 2015 for the corresponding international application No. PCT/JP2014/074927 (and English translation).
(Continued)

*Primary Examiner* — Mark Laurenzi
*Assistant Examiner* — Deming Wan
(74) *Attorney, Agent, or Firm* — Posz Law Group, PLC

(57) ABSTRACT

A scroll compressor in which a winding angle of a first lap is larger than a winding angle of a second lap, a plurality of compression chambers are formed between the first lap and the second lap, the compression chambers include at least a first compression chamber and a second compression chamber that has a volume smaller than the first compression chamber, a first base plate is provided with a first injection port **16*a*** for injection of refrigerant into the first compression chamber and a second injection port for injection of refrigerant into the second compression chamber, and an injection flow rate of the second injection port is higher than an injection flow rate of the first injection port.

13 Claims, 5 Drawing Sheets

(51) Int. Cl.

| | |
|---|---|
| ***F04C 18/02*** | (2006.01) |
| ***F04C 15/06*** | (2006.01) |
| ***F04C 29/04*** | (2006.01) |
| ***F04C 27/00*** | (2006.01) |

(52) U.S. Cl.
CPC ..... *F04C 27/005* (2013.01); *F04C 29/042* (2013.01); *F04C 2210/1022* (2013.01); *F04C 2210/263* (2013.01); *F04C 2240/30* (2013.01)

(58) Field of Classification Search
USPC ..... 418/15, 55.1, 55.2, 58, 185, 186, 180
See application file for complete search history.

(56) References Cited

U.S. PATENT DOCUMENTS

2010/0212352 A1* 8/2010 Kim ..... F04C 18/0215 62/498
2013/0108496 A1* 5/2013 Nakai ..... F04C 18/0215 418/55.1
2015/0139818 A1* 5/2015 Nagata ..... F04C 28/06 417/45
2016/0348676 A1* 12/2016 Ogata ..... F04C 18/0215

FOREIGN PATENT DOCUMENTS

| | | | |
|---|---|---|---|
| JP | 2009-228478 | A | 10/2009 |
| JP | 2012-131994 | A | 7/2012 |
| JP | 2012-247134 | A | 12/2012 |
| JP | 2014-020253 | A | 2/2014 |
| JP | 2014-509706 | A | 4/2014 |

OTHER PUBLICATIONS

Office Action dated Feb. 6, 2018 issued in corresponding JP patent application No. 2016-548523 (and English translation).
Office Action dated Aug. 1, 2017 issued in corresponding JP patent application No. 2016-548523 (and English translation).

* cited by examiner

SCROLL COMPRESSOR

CROSS REFERENCE TO RELATED APPLICATION

This application is a U.S. national stage application of PCT/JP2014/074927 filed on Sep. 19, 2014, the contents of which are incorporated herein by reference.

TECHNICAL FIELD

The present invention relates to a scroll compressor that is mainly mounted on refrigerators, air-conditioners, water heaters, or other apparatuses.

BACKGROUND ART

In recent years, scroll compressors that use refrigerant such as HFO refrigerant having a global warming potential (GWP) lower than the conventional HFC refrigerant have been developed in view of preventing global warming. Typical examples of HFO refrigerant include 2,3,3,3-tetrafluoro-1-propene. However, since HFO refrigerant has low refrigeration capacity per unit volume, the scroll compressor is required to have an increased suction volume to ensure refrigeration capacity equivalent to the refrigeration capacity when using the conventional HFC refrigerant. Accordingly, there is a known technique for increasing a suction volume by increasing a stroke volume of the compressor by use of an asymmetrical spiral structure in which a winding angle of a stationary scroll wrap that constitutes a compression chamber is formed to be larger than a winding angle of an orbiting scroll wrap (for example, see Patent Literature 1).

However, in the case where a single-component refrigerant of HFO refrigerant, which typically includes 2,3,3,3-tetrafluoro-1-propene, or a mixed refrigerant that contains HFO refrigerant is used in a scroll compressor having an asymmetrical spiral structure, a discharge temperature of refrigerant after compression may increase depending on operation conditions, which may cause deterioration of refrigerating machine oil and lead to a failure of the scroll compressor.

Accordingly, there is a known technique for injecting refrigerant of an intermediate pressure into a compression chamber via one injection port to cool and lower a discharge temperature and thereby to improve reliability while improving efficiency by reducing a work load (see, for example, Patent Literature 2).

According to Patent Literature 2, in a scroll compressor having an asymmetrical spiral structure, one injection port for injecting refrigerant of an intermediate pressure into a compression chamber is provided on a base plate of a stationary scroll at a position satisfying the following conditions (1) to (3) to increase an injection flow rate and thereby improve efficiency.

(1) The position where the injection port opens to a compression chamber having a large sealing volume and a compression chamber having a small sealing volume in sequence and allows for sequential injection into these two compression chambers.

(2) The position where the injection amount into the compression chamber having a small sealing volume is larger than the injection amount into the compression chamber having a large sealing volume.

(3) The position located in an outer region of a line that is offset from an outer line of the stationary scroll wrap by a thickness of the orbiting scroll wrap and in an inner region of a line that is offset from an inner line of the stationary scroll wrap by a thickness of the orbiting scroll wrap, and where injected refrigerant does not leak into a suction side.

CITATION LIST

Patent Literature

Patent Literature 1: Japanese Unexamined Patent Application Publication No. 2009-228478 (e.g., see [0020] and FIG. 3)

Patent Literature 2: Japanese Patent No. 4265128 (e.g.; see claim 1, [0020], and FIG. 4)

SUMMARY OF INVENTION

Technical Problem

However, according to the conventional technique described in Patent Literature 2, there is a problem that an injection flow rate is limited since a single injection port is provided and that the discharge temperature may not be lowered enough depending on operation conditions. Further, in the case where the injection pressure is increased to ensure the injection flow rate, an input of the compressor increases and thereby causes a decrease in coefficient of performance (COP).

The present invention has been made to overcome the above problem, and has an object to provide a scroll compressor that can ensure refrigeration capacity equivalent to the refrigeration capacity when using the HFC refrigerant even if the scroll compressor uses refrigerant having a global warming potential (GWP) lower than the conventional HFC refrigerant, while reducing a decrease in coefficient of performance (COP).

Solution to Problem

A scroll compressor according to an embodiment of the present invention includes: a shell configured as a hermetic container forming an enclosure; and a compression mechanism section provided in the shell and configured to compress refrigerant, the compression mechanism section including a stationary scroll and an orbiting scroll, the stationary scroll including a first base plate and a first wrap, the first wrap being provided to erect along an involute curve on one surface of the first base plate, the orbiting scroll including a second base plate and a second wrap, the second wrap being provided to erect along an involute curve on one surface of the second base plate, the first wrap having a winding angle larger than a winding angle of the second wrap, the first wrap and the second wrap being configured to form a plurality of compression chambers between the first wrap and the second wrap, the volume of each of the compression chambers being smaller than volumes of compression chambers formed radially outward thereof, the compression chambers including at least a first compression chamber and a second compression chamber, the second compression chamber having a volume smaller than the volume of the first compression chamber, the first base plate being provided with a first injection port for injection of refrigerant into the first compression chamber and a second injection port for injection of refrigerant into the second compression chamber, and the second injection port being configured to provide an injection flow rate higher than an injection flow rate of the first injection port

Advantageous Effects of Invention

According to the scroll compressor of an embodiment of the present invention, asymmetrical spiral configuration in which the winding angle of the first wrap of the stationary scroll is larger than the winding angle of the second wrap of the orbiting scroll can ensure refrigeration capacity equivalent to the refrigeration capacity when using HFC refrigerant even if refrigerant having a global warming potential (GWP) lower than the conventional HFC refrigerant is used. Further, since the scroll compressor is configured that the injection flow rate of the second injection port is higher than the injection flow rate of the first injection port, the input of the scroll compressor can be reduced by ensuring an appropriate injection flow rate, thereby reducing a decrease in coefficient of performance (COP).

DESCRIPTION OF EMBODIMENTS

With reference to the drawings, embodiments of the present invention will be described. It should be noted that the present invention is not intended to be limited by those embodiments described below. In the accompanying drawings, the components may not be drawn to scale.

Embodiment 1

Figure 1:
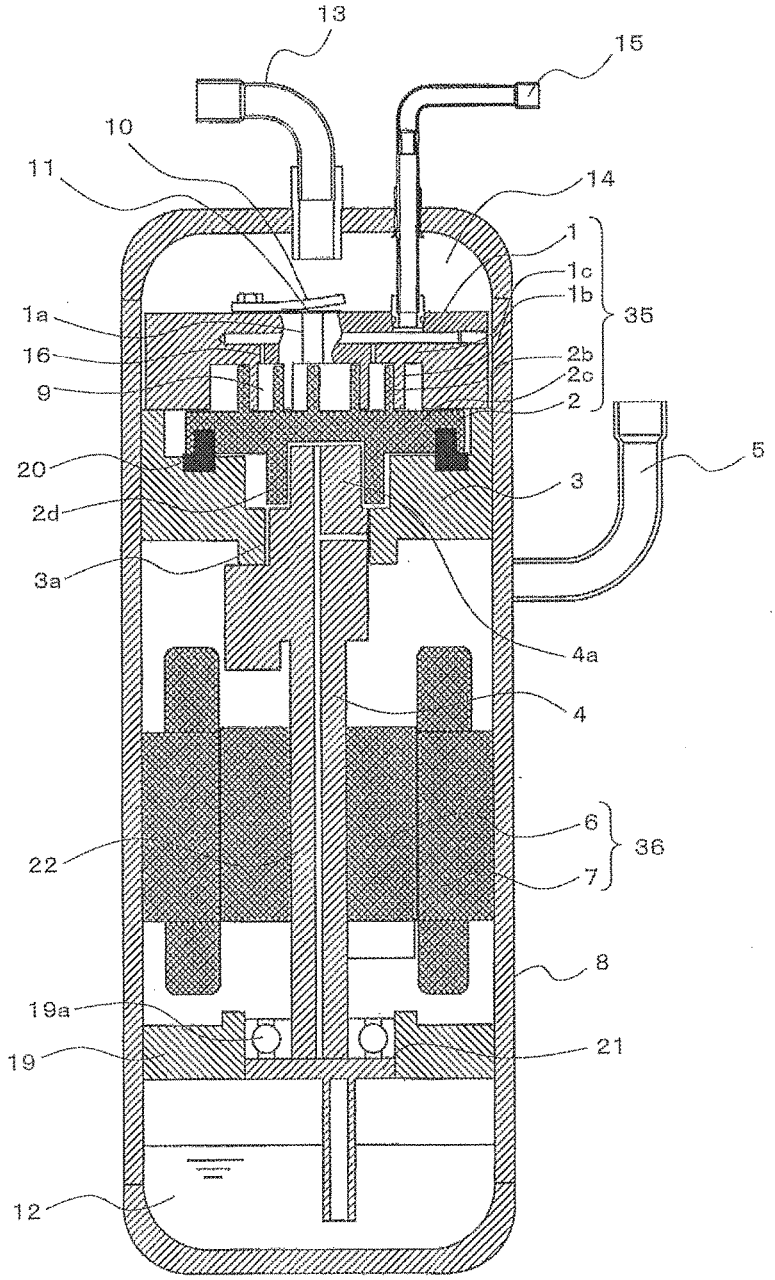
FIG. 1 illustrates a vertical section of a scroll compressor according to Embodiment 1 of the present invention.

FIG. 1 illustrates a vertical section of a scroll compressor according to Embodiment 1 of the present invention.

As illustrated in FIG. 1, Embodiment 1 describes an example of a hermetic scroll compressor, in which low-pressure side refrigerant acts on a hermetic container. The scroll compressor has functions of suctioning a fluid such as refrigerant and compressing the fluid into a high temperature and high pressure fluid to be discharged. The scroll compressor is configured to house a compression mechanism section 35, a drive mechanism section 36, and other components in a shell 8, which is a hermetic container that forms an enclosure. The compression mechanism section 35 and the drive mechanism section 36 are disposed in an upper part and a lower part inside the shell 8, respectively. Further, an oil sump 12 is formed at the bottom of the shell 8. The scroll compressor of Embodiment 1 uses refrigerant having a global warming potential (GWP) lower than the conventional HFC refrigerant.

The compression mechanism section 35 has a function of compressing a fluid suctioned from a suction tube 5 formed on a side surface of the shell 8 to obtain a high pressure fluid and then discharging the fluid into a high pressure space 14 formed in an upper portion of the shell 8. The high pressure fluid is discharged outside the scroll compressor from a discharge tube 13 provided on the upper side of the shell 8.

The drive mechanism section 36 serves to drive an orbiting scroll 2 that constitutes the compression mechanism section 35. That is, the drive mechanism section 36 drives the orbiting scroll 2 via a crankshaft 4, and thereby the compression mechanism section 35 compresses a fluid.

The compression mechanism section 35 is made up of a stationary scroll 1 and the orbiting scroll 2. As illustrated in FIG. 1, the orbiting scroll 2 is disposed on a lower side of the stationary scroll 1 and the stationary scroll 1 is disposed on an upper side of the orbiting scroll 2.

The stationary scroll 1 is made up of a first base plate 1*c*, and a first wrap 1*b* that is a spiral shaped wrap provided to erect on one surface of the first base plate 1*c* (lower surface in FIG. 1) along an involute curve.

The orbiting scroll 2 is made up of a second base plate 2*c*, and a second wrap 2*b* that is a spiral shaped wrap provided to erect on one surface of the second base plate 2*c* (upper surface in FIG. 1) along an involute curve.

The stationary scroll 1 and the orbiting scroll 2 are mounted in the shell 8 with the first wrap 1*b* and the second wrap 2*b* meshing with each other.

Further, a plurality of compression chambers 9 are formed between the first wrap 1*b* and the second wrap 2*b*, each of the compression chambers having a volume smaller than volumes of compression chambers formed radially outward thereof. The outermost chamber of the compression chambers 9 formed between an inward surface of the first wrap 1*b* and an outward surface of the second wrap 2*b* is referred to as a first compression chamber 9*a*, while the outermost chamber of the compression chambers 9 formed between an outward surface of the first wrap 1*b* and an inward surface of the second wrap 2*b* is referred to as a second compression chamber 9*b*.

Figure 2:
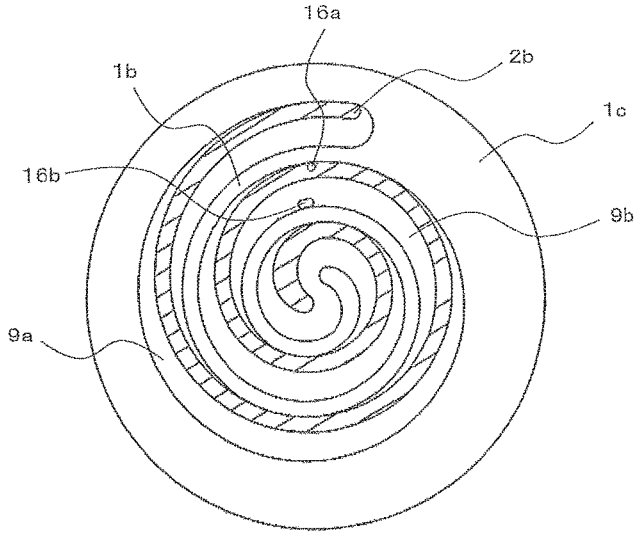
FIG. 2 is a detailed view of a compression mechanism section of the scroll compressor according to Embodiment 1 of the present invention.

FIG. 2 is a detailed view of the compression mechanism section 35 of the scroll compressor according to Embodiment 1 of the present invention.

As illustrated in FIG. 2, the scroll compressor according to Embodiment 1 has an asymmetrical spiral structure in which a winding angle (end angle) of the first wrap 1*b* of the stationary scroll 1 is larger than a winding angle of the second wrap 2*b* of the orbiting scroll 2 in the compression mechanism section 35.

Since the winding angle of the first wrap 1*b* of the stationary scroll 1 is formed larger than the winding angle of the second wrap 2*b* of the orbiting scroll 2 to obtain a volume of the first compression chamber 9*a* (at the completion of suctioning) larger than the volume of the second compression chamber 9*b* (at the completion of suctioning), a stroke volume is increased. This increases the suction volume, thereby increasing the refrigerant amount of the compression chamber 9 suctioned during a rotation.

To maximize the effect of the asymmetric structure, the winding angle of the first wrap 1*b* of the stationary scroll 1 may be larger than the winding angle of the second wrap 2*b* of the orbiting scroll 2 by approximately 180 degrees.

In the case where the stationary scroll 1 and the orbiting scroll 2 are housed in the shell 8, the outer circumferential positions of the first wrap 1*b* and the second wrap 2*b* may be restrictive. Here, the winding angle of the first wrap 1*b* of the stationary scroll 1 may be formed larger than the winding angle of the second wrap 2*b* of the orbiting scroll 2 by approximately 180 degrees, and the outer circumferential end of the first wrap 1*b* of the stationary scroll 1 comes to a position substantially the same as the outer circumferential end of the second wrap 2*b* of the orbiting scroll 2. Accordingly, the stationary scroll 1 and the orbiting scroll 2 can be housed without increasing the inner diameter of the shell 8.

On the first base plate 1*c* of the stationary scroll 1, two injection ports 16 are provided to inject refrigerant of an intermediate pressure into the compression chambers 9.

One of the injection ports 16 is a first injection port 16*a* for injecting refrigerant into the first compression chamber 9*a*, and the other thereof is a second injection port 16*b* for injecting refrigerant into the second compression chamber 9*b*. The second injection port 16*b* has an area larger than the first injection port 16*a*. Further, the first injection port 16*a* and the second injection port 16*b* are provided at positions that do not allow the injected refrigerant to flow into a lower pressure space.

As illustrated in FIG. 1, the stationary scroll 1 is fixed inside the shell 8 via a frame 3. A discharge port 1*a* is formed at the center part of the stationary scroll 1 so that a high pressure fluid pressurized by compression is discharged therethrough. At an outlet opening of the discharge port 1*a*, a valve 11 formed of a leaf spring is disposed to cover the outlet opening and prevent backflow of the high pressure fluid. At one end of the valve 11, a valve guard 10 is provided to limit a lift amount of the valve 11. That is, when the fluid is compressed in the compression chambers 9 to a predetermined pressure, the valve 11 is lifted against its own elastic force by the compressed high pressure fluid. Then, the high pressure fluid is discharged from the discharge port 1*a* into the high pressure space 14, and then discharged outside the scroll compressor via the discharge tube 13.

The orbiting scroll 2 performs an eccentric revolving movement to the stationary scroll 1 without rotating on its axis. Further, a recessed bearing 2*d* of a hollow cylindrical shape that receives a driving force is formed at the substantially center on a surface (hereinafter, referred to as a thrust surface) of the orbiting scroll 2 opposite to the surface where the second wrap 2*b* is formed. An eccentric pin section 4*a* formed on an upper end of the crankshaft 4 (described below) is fitted (engaged) in the recessed bearing 2*d*.

The drive mechanism section 36 is housed vertically in the shell 8, and is made up of at least the crankshaft 4 that is a rotation shaft, a stator 7 that is fixedly held in the shell 8, and a rotor 6 that is rotatably disposed on an inner periphery of the stator 7 and fixed to the crankshaft 4. The stator 7 has a function of actuating rotation of the rotor 6 when the stator 7 is energized. An outer peripheral surface of the stator 7 is, for example, shrink-fitted and fixedly supported by an inner peripheral surface of the shell 8. When the stator 7 is energized, the rotor 6 rotates to cause rotation of the crankshaft 4. The rotor 6 has a permanent magnet inside, is fixed to an outer periphery of the crankshaft 4, and is held with a slight gap between the rotor 6 and the stator 7.

The crankshaft 4 rotates with the rotation of the rotor 6, thereby rotating the orbiting scroll 2. The crankshaft 4 is rotatably supported at an upper end by a bearing section 3*a* that is positioned at the center of the frame 3, and at a lower end by a sub-bearing 19*a* that is positioned at the center of a sub-frame 19 that is fixedly provided in a lower part of the shell 8. Further, the upper end of the crankshaft 4 has the eccentric pin section 4*a* that is fitted in the recessed bearing 2*d* and allows the orbiting scroll 2 to eccentrically rotate.

The suction tube 5 for suctioning a fluid, the discharge tube 13 for discharging a fluid, and an injection tube 15 for injecting a fluid into the compression chambers 9 are connected to the shell 8. The suction tube 5 is disposed on a side surface of the shell 8, and the discharge tube 13 and the injection tube 15 are disposed on an upper side of the shell 8.

Further, the frame 3 and the sub-frame 19 are fixed inside the shell 8.

The frame 3 is fixed to the upper side of the inner peripheral surface of the shell 8 and has a through hole at the center to support the crankshaft 4. The frame 3 supports the orbiting scroll 2 while rotatably supporting the crankshaft 4 via the bearing section 3*a*. An outer peripheral surface of the frame 3 may be fixed to the inner peripheral surface of the shell 8 by shrink-fitting, welding, or using other fixing methods.

The sub-frame 19 is fixed to the lower side of the inner peripheral surface of the shell 8 and has a through hole at the center to support the crankshaft 4. The sub-frame 19 rotatably supports the crankshaft 4 via the sub-bearing 19*a*.

Further, an Oldham ring 20 is disposed in the shell 8 to prevent rotation movement of the orbiting scroll 2 during eccentric revolving movement thereof. The Oldham ring 20 is disposed between the stationary scroll 1 and the orbiting scroll 2 and serves to prevent rotation movement of the orbiting scroll 2 while allowing for revolving movement.

An oil pump 21 is fixed under the crankshaft 4. The oil pump 21 is a volume-type pump, and, according to rotation of the crankshaft 4, serves to supply refrigerating machine oil stored in the oil sump 12 to the recessed bearing 2*d* and the bearing section 3*a* through an oil path 22 in the crankshaft 4.

An operation of the scroll compressor according to Embodiment 1 will be briefly described.

When power is supplied to a power supply terminal (not illustrated) disposed on the shell 8, a torque is generated at the stator 7 and the rotor 6, thereby rotating the crankshaft 4. Accordingly, the orbiting scroll 2, which is rotatably fitted in an eccentric pin section 4*a* of the crankshaft 4, performs an eccentric revolving movement, and this causes the volume of the compression chambers 9 formed by the first wrap 1*b* and the second wrap 2*b* to decrease. Due to this stroke, refrigerant suctioned from the suction tube 5 into the compression chambers 9 is compressed, thereby the temperature and pressure thereof being increased.

Figure 3:
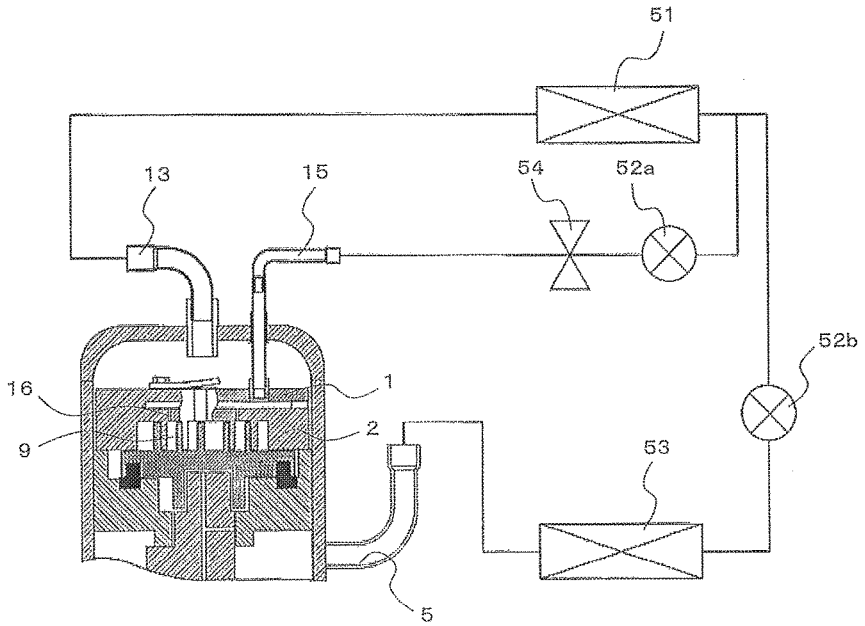
FIG. 3 is a view of a refrigerant circuit in which the scroll compressor according to Embodiment 1 of the present invention is incorporated.

FIG. 3 is a view of a refrigerant circuit in which the scroll compressor according to Embodiment 1 of the present invention is incorporated.

FIG. 3 illustrates an example of a liquid injection cycle to which the present invention is applied and which is filled with 2,3,3,3-tetrafluoro-1-propene (hereinafter, "HFO-1234yf," chemical formula CF3-CF═CH2) as refrigerant.

For example, when the difference between a suction temperature and a discharge temperature of the scroll compressor is large, that is, when the pressure difference between high and low pressures of the suction side and the discharge side of the scroll compressor is large, the refrigerant discharged from the discharge tube 13 has high temperature. Accordingly, the scroll compressor is operated with a decreased discharge temperature by performing injection of liquid refrigerant taken out through an outlet of the condenser 51 into the compression chamber 9.

Liquid refrigerant of high pressure, after taken out from the condenser 51, is subject to control of an expansion rate and a flow rate by an expansion valve 52*a* and a solenoid valve 54, and flows through an injection pipe 15 into the scroll compressor. Liquid refrigerant passes inside the stationary scroll 1, flows through the injection port 16, and is introduced into the compression chambers 9, thereby cooling refrigerant during compression. On the other hand, gas refrigerant taken out from the outlet of the condenser 51 is subject to control of an expansion rate by the expansion valve 52*b*, flows through the evaporator 53 back into the scroll compressor via the suction tube 5, and is again suctioned into the compression chambers 9.

Figure 4:
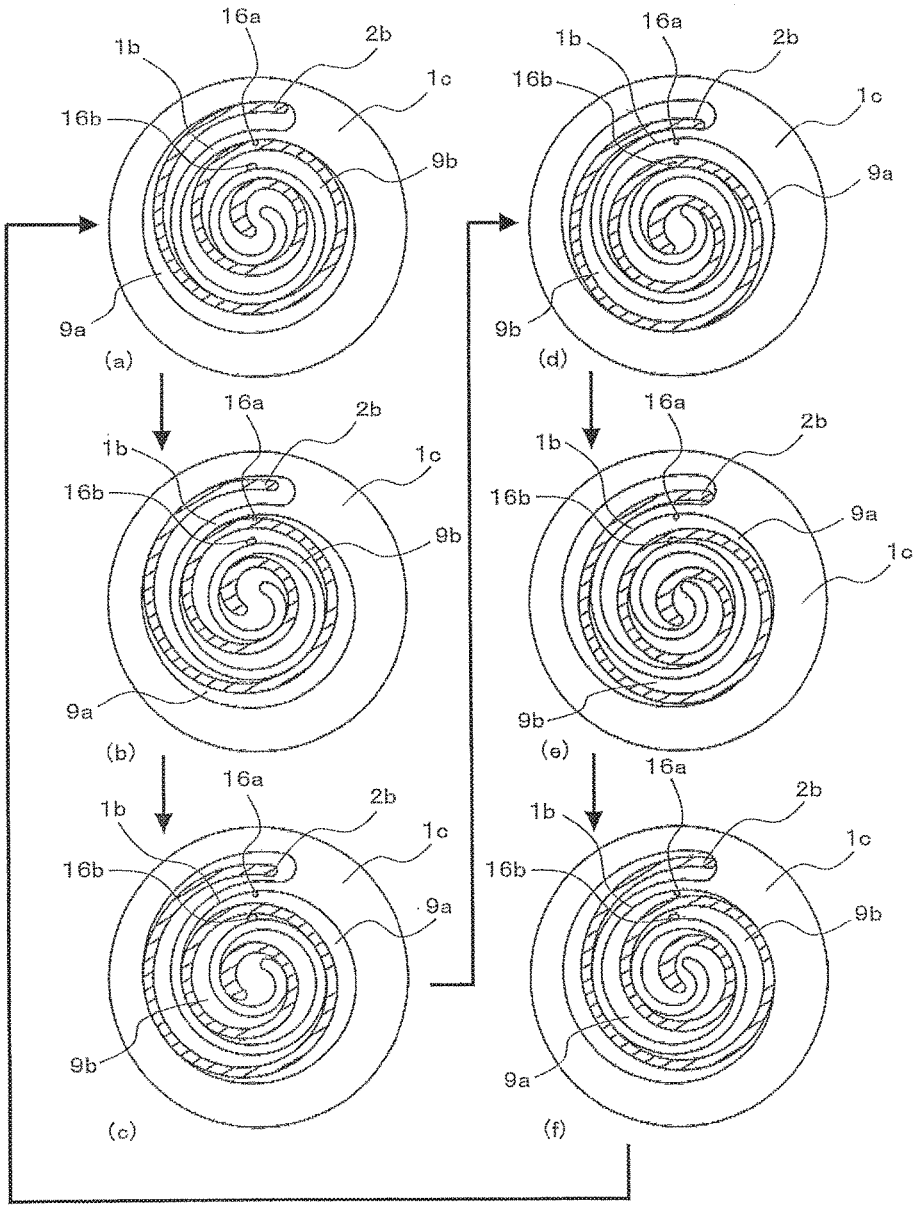
FIG. 4 is a compression process diagram of the compression mechanism section of the scroll compressor according to Embodiment 1 of the present invention.

FIG. 4 is a compression process diagram of a compression mechanism section 35 of the scroll compressor according to Embodiment 1 of the present invention. In FIG. 4, (a) to (f) illustrate the compression process of the compression chamber 9 by every 60 degrees.

The first compression chamber 9*a* and the second compression chamber 9*b* move toward a center 1*d* of the stationary scroll 1 (see FIG. 5 as described later) while reducing each volume with an eccentric revolving movement of the orbiting scroll 2, thereby compressing refrigerant.

FIG. 4 (*a*) illustrates that the first compression chamber 9*a* having a large volume formed by the stationary scroll 1 and the orbiting scroll 2 has finished suctioning of refrigerant (closing completion angle 0 degrees). Here, the first injection port 16*a* does not yet communicate with the first compression chamber 9*a*.

FIG. 4 (*b*) illustrates that the eccentric revolving movement of the orbiting scroll 2 has proceeded, the first injection port 16*a* partially communicates with the first compression chamber 9*a*, and injection has started.

FIG. 4 (*c*) illustrates that the eccentric revolving movement of the orbiting scroll 2 has further proceeded, the first injection port 16*a* completely communicates with the first compression chamber 9*a*, and injection is being performed.

FIG. 4 (*d*) illustrates that the eccentric revolving movement of the orbiting scroll 2 has further proceeded, and the second compression chamber 9*b* having a small volume has finished suctioning of refrigerant. Here, the second injection port 16*b* does not yet communicate with the second compression chamber 9*b*. Meanwhile, the first compression chamber 9*a* still completely communicates with the first injection port 16*a*, and injection is being performed.

FIG. 4 (*e*) illustrates that the eccentric revolving movement of the orbiting scroll 2 has further proceeded, the second injection port 16*b* partially communicates with the second compression chamber 9*b*, and injection has started. Meanwhile, the first compression chamber 9*a* still completely communicates with the first injection port 16*a*, and injection is being performed.

FIG. 4 (*f*) illustrates that the eccentric revolving movement of the orbiting scroll 2 has further proceeded, the second injection port 16*b* completely communicates with the second compression chamber 9*b*, and full-blown injection is being performed. Meanwhile, the first injection port 16*a* starts closing from the first compression chamber 9*a*.

Then, when the eccentric revolving movement of the orbiting scroll 2 further proceeds and returns to the state illustrated in FIG. 4 (*a*), the first injection port 16*a* is completely closed from the first compression chamber 9*a*. The second injection port 16*b* still completely communicates with the second compression chamber 9*b*, and thereby allows for injection.

Figure 5:
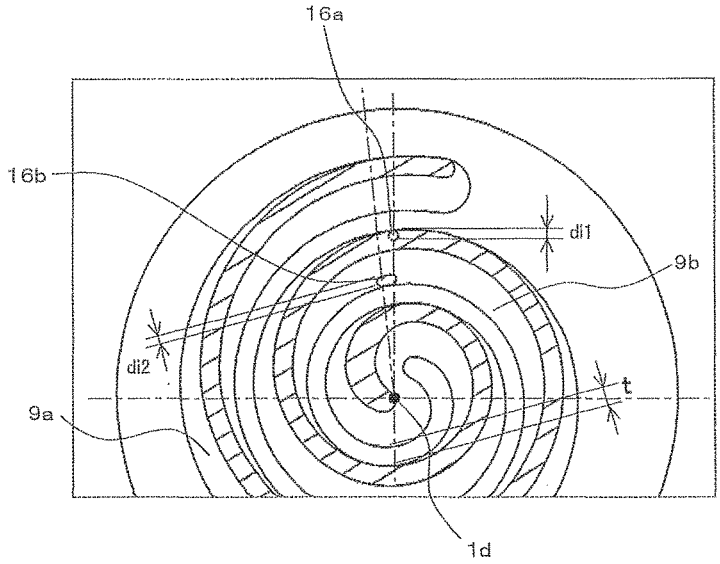
FIG. 5 is an enlarged view of a stationary scroll of the scroll compressor according to Embodiment 1 of the present invention.

FIG. 5 is an enlarged view of the stationary scroll 1 of the scroll compressor according to Embodiment 1 of the present invention.

Two different compression chambers 9 (the first compression chamber 9*a* and the second compression chamber 9*b*) need to be prevented from communicating with each other via the injection port 16 (the first injection port 16*a* or the second injection port 16*b*). Therefore, as illustrated in FIG. 5, a length in the radial direction di1 of the first injection port 16*a* and a length in the radial direction di2 of the second injection port 16*b* relative to the center 1*d* of the stationary scroll 1 should be smaller than a thickness t of the second wrap 2*b* of the orbiting scroll 2.

Accordingly, during a period in which one of the injection ports 16 communicates with a compression chamber 9, the other of the injection ports 16 is completely closed by the second wrap 2*b* of the orbiting scroll 2 from the compression chamber 9. As a result, two different compression chambers 9 can be prevented from communicating with each other via the injection ports 16.

Further, in the case where the low-pressure side refrigerant acts on the shell 8 that is a hermetic container, a gap (first gap) of several tens of μm in a height direction (erecting direction of the first wrap 1*b*) is formed between the first wrap 1*b* of the stationary scroll 1 and the second base plate 2*c* of the orbiting scroll 2 to avoid seizure due to heat expansion. Similarly, a gap (second gap) of several tens of μm in a height direction (erecting direction of the second wrap 2*b*) is formed between the second wrap 2*b* of the orbiting scroll 2 and the first base plate 1*c* of the stationary scroll 1.

Figure 6:
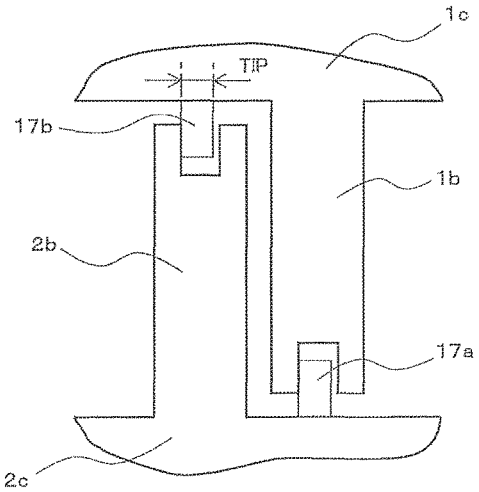
FIG. 6 is a schematic view of the compression mechanism section of the scroll compressor according to Embodiment 1 of the present invention.

FIG. 6 is a schematic view of the compression mechanism section 35 of the scroll compressor according to Embodiment 1 of the present invention.

To seal the gaps, a stationary scroll tip seal 17*a* is mounted on a tip of the first wrap 1*b* and an orbiting scroll tip seal 17*b* is mounted on a tip of the second wrap 2*b* as illustrated in FIG. 6, and the stationary scroll tip seal 17*a* and the orbiting scroll tip seal 17*b* are lifted by a pressure difference to thereby seal the gaps.

Here, a thickness TIP in the radial direction of the orbiting scroll tip seal 17*b* relative to the center 1*d* of the stationary scroll 1 needs to be larger than the length in the radial direction di1 of the first injection port 16*a* and the length in the radial direction di2 of the second injection port 16*b* to prevent two different compression chambers 9 from communicating with each other.

If one injection port 16 is provided, the injection port 16 moves across two compression chambers 9 in sequence to inject liquid refrigerant during one rotation of the orbiting scroll 2. Consequently, the amount of liquid refrigerant injected into the respective compression chambers 9 decreases, which may cause an increase in discharge temperature. The pressure of liquid refrigerant injected may be increased to forcibly inject liquid refrigerant. However, this technique requires an extra drive power since the pressure in the compression chambers 9 also increases.

On the other hand, according to Embodiment 1 in which two injection ports 16 are provided, an appropriate injection flow rate may be ensured for two compression chambers 9, thereby preventing an increase in discharge temperature and an increase in input of the scroll compressor.

Figure 7:
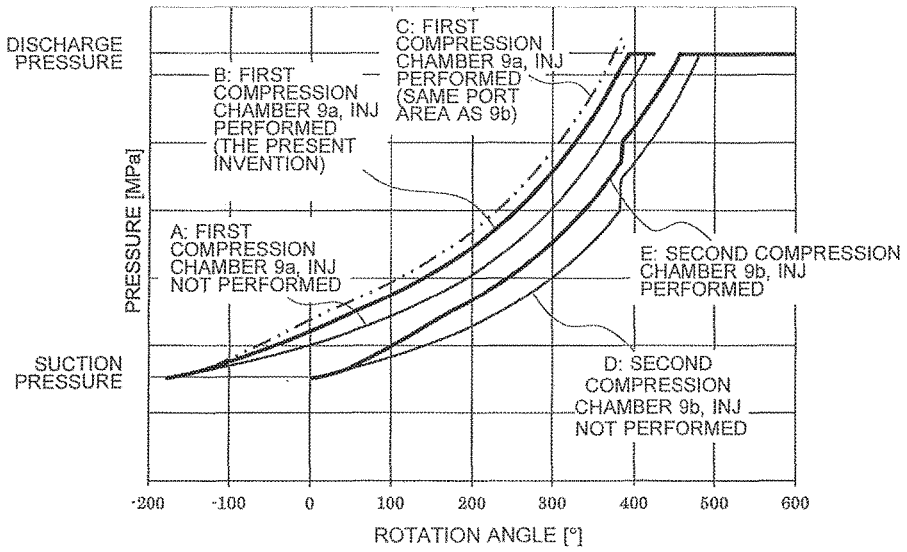
FIG. 7 is a view of compression lines of compression chambers of the scroll compressor according to Embodiment 1 of the present invention.

FIG. 7 is a view of compression lines of the compression chambers 9 of the scroll compressor according to Embodiment 1 of the present invention. In FIG. 7, "INJ" represents "injection."

As illustrated in FIG. 7, as liquid refrigerant is injected into the compression chambers 9, the pressure increases.

Here, since the scroll compressor according to Embodiment 1 has an asymmetrical spiral structure, the first compression chamber 9*a* and the second compression chamber 9*b* have different volumes and rotation angles at the completion of suctioning of refrigerant. Accordingly, the pressure is imbalanced between the first compression chamber 9*a* and the second compression chamber 9*b*, which causes unstable behavior of the orbiting scroll 2. When the behavior of the orbiting scroll 2 is unstable, a load is applied on the Oldham ring 20 that prevents rotation of the orbiting scroll 2 and on a thrust surface between the orbiting scroll 2 and the frame 3, thereby reducing reliability.

According to Embodiment 1, an area of the second injection port 16*b* is formed to be larger than an area of the first injection port 16*a*. Therefore, the amount of refrigerant that flows from the second injection port 16*b* into the second compression chamber 9*b* (that is, an injection flow rate of the second injection port 16*b*) is larger than the amount of refrigerant that flows from the first injection port 16*a* into the first compression chamber 9*a* (that is, an injection flow rate of the first injection port 16*a*). Since this configuration allows the pressure increase (from D to E in FIG. 7) in the second compression chamber 9*b* that has a volume smaller than the first compression chamber 9*a* and has a low original pressure to be larger than the pressure increase (from A to B in FIG. 7) in the first compression chamber 9*a*, the imbalance in pressure between the first compression chamber 9*a* and the second compression chamber 9*b* can be reduced, thereby stabilizing the behavior of the orbiting scroll 2. That is, ensuring an appropriate injection flow rate allows for compression of refrigerant without requiring extra work, thereby decreasing the input of the scroll compressor.

On the other hand, if the area of the second injection port 16*b* is the same as the area of the first injection port 16*a*, the injection flow rate of the first injection port 16*a* is the same as the injection flow rate of the second injection port 16*b*. As a consequence, the difference between the pressure in the first compression chamber 9*a* (C in FIG. 7) and the pressure in the second compression chamber 9*b* (E in FIG. 7) remains large, and thus the imbalance in the pressure between the first compression chamber 9*a* and the second compression chamber 9*b* is not reduced and the behavior of the orbiting scroll 2 is not stable.

Further, in the case where the area of the second injection port 16*b* is formed to be larger than the area of the first injection port 16*a*, the behavior of the orbiting scroll 2 is stable compared with the case where the areas of the first injection port 16*a* and the second injection port 16*b* are the same. Accordingly, the reliability of the thrust bearing provided on the orbiting scroll 2 can also be improved.

In general, the injection flow rate is proportional to the area of the injection port 16, and in the asymmetrical spiral structure, the winding angle (end angle) of the first wrap 1*b* of the stationary scroll 1 is configured to be larger than the winding angle of the second wrap 2*b* of the orbiting scroll 2 by approximately 180 degrees. Considering the above, the area of the first injection port 16*a* is preferably in the range approximately from 80 to 90 percent of the area of the second injection port 16*b*. This is because the volume of the first compression chamber 9*a* becomes 1.1 to 1.2 times the volume of the second compression chamber 9*b* when the winding angle of the first wrap 1*b* of the stationary scroll 1 is formed to be larger than the winding angle of the second wrap 2*b* of the orbiting scroll 2 by approximately 180 degrees.

Embodiment 1 has been described on the liquid injection cycle. However, an embodiment of the present invention can also be applied to a gas injection cycle that improves heating capacity in the heating application of air-conditioners or water heaters, to thereby prevent an increase in input of the compressor.

Embodiment 2

Figure 8:
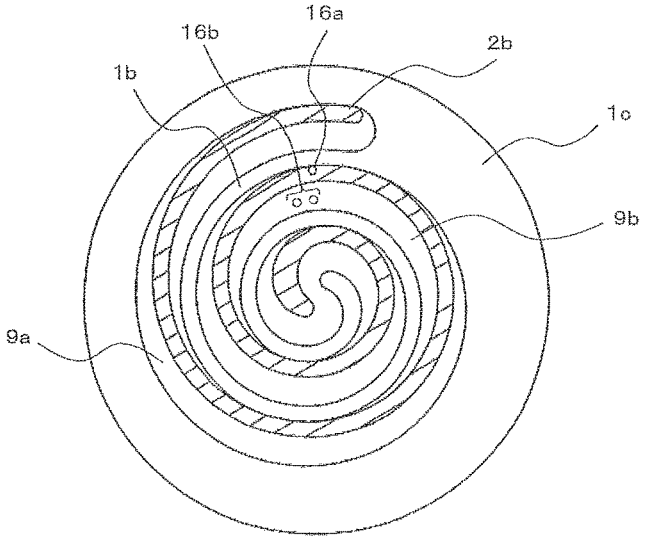
FIG. 8 is a detailed view of a compression mechanism section of a scroll compressor according to Embodiment 2 of the present invention.

FIG. 8 is a detailed view of a compression mechanism section 35 of a scroll compressor according to Embodiment 2 of the present invention.

Embodiment 2 will be described below, in which the same or corresponding parts as those of Embodiment 1 are indicated by the same reference numbers, and the description thereof is omitted.

In Embodiment 2, while the area of the first injection port 16*a* is the same as the area of the second injection port 16*b*, the number of second injection ports 16*b* (two) is larger than the number of the first injection port 16*a* (one). In addition, each injection port 16 has the same area. In this configuration as well, the same effect as that of Embodiment 1 can be obtained.

Further, in Embodiment 1 in which the area of the second injection port 16*b* is larger than the area of the first injection port 16*a*, two types of drills are necessary for processing the injection ports 16. However, in Embodiment 2, the injection ports 16 can be processed with a one type of drill, which allows for simple processing compared with Embodiment 1, and thus the cost can be reduced.

While the number of the second injection ports 16*b* is two and the number of the first injection port 16*a* is one In Embodiment 2, an embodiment of the invention is not limited thereto. Any number is possible as long as the number of the second injection ports 16*b* is larger than the number of the first injection port 16*a*.

As described above, according to the scroll compressor of Embodiments 1 and 2, an asymmetrical spiral structure in which the winding angle of the first wrap 1*b* is larger than the winding angle of the second wrap 2*b* can ensure refrigeration capacity equivalent to the refrigeration capacity of HFC refrigerant even if refrigerant having a global warming potential (GWP) lower than the conventional HFC refrigerant is used.

Further, the first injection port 16*a* and the second injection port 16*b* are provided on the first base plate 1*c* of the stationary scroll 1, the area of the second injection port 16*b* is larger than the area of the first injection port 16*a*, and the injection flow rate of the second injection port 16*b* is higher than the injection flow rate of the first injection port 16*a*. In this configuration, the imbalance in pressure between the first compression chamber 9*a* and the second compression chamber 9*b* is reduced, thereby stabilizing the behavior of the orbiting scroll 2.

That is, ensuring an appropriate injection flow rate allows for compression of refrigerant without requiring extra work, thereby decreasing the input of the scroll compressor and reducing a decrease in coefficient of performance (COP). Moreover, the reliability of the thrust bearing provided on the orbiting scroll 2 can be improved.

Embodiments 1 and 2 are described as using HFO-1234yf as refrigerant. Other than HFO-1234yf, 1,3,3,3-tetrafluoro-1-propene ("HFO-1234ze", chemical formula CF3-

CH=CHF), 1,2,3,3,3-pentafluoro-1-propene ("HFO-1225ye", chemical formula CF3-CF=CHF), 1,2,3,3-tetrafluoro-1-propene ("HFO-1234ye", chemical formula CHF2-CF=CHF), or 3,3,3-trifluoro-1-propene ("HFO-1234zf", chemical formula CF3-CH=CH2), for example, may be used as refrigerant.

Further, a mixed refrigerant may be used in which refrigerant expressed by chemical formula: C3HmFn (where m and n are integers of 1 or more and 5 or less, and a relationship of m+n=6 is established) and containing one double bond in the molecular structure is mixed with refrigerant that is at least one of HFC-32 (difluoromethane), HFC-125 (pentafluoroethane), HFC-134 (1,1,2,2-tetrafluoroethane), HFC-134a (1,1,1,2-tetrafluoroethane), HFC-143a (1,1,1-trifluoroethane), methane, ethane, propane, carbon dioxide, helium, and 1,1,2-trifluoroethene ("HFO-1123").

REFERENCE SIGNS LIST

1 stationary scroll 1*a* discharge port 1*b* first wrap 1*c* first base plate 1*d* center 2 orbiting scroll 2*b* second wrap 2*c* second base plate 2*d* recessed bearing 3 frame 3*a* bearing section 4 crankshaft 4*a* eccentric pin section 5 suction tube 6 rotor 7 stator 8 shell 9 compression chamber 9*a* first compression chamber 9*b* second compression chamber 10 valve guard 11 valve 12 oil sump 13 discharge tube 14 high pressure space 15 injection pipe 16 injection port 16*a* first injection port 16*b* second injection port 17*a* stationary scroll tip seal 17*b* orbiting scroll tip seal 19 sub-frame 19*a* sub-bearing 20 Oldham ring 21 oil pump 22 oil path 35 compression mechanism section 36 drive mechanism section 51 condenser 52*a* expansion valve 52*b* expansion valve 53 evaporator 54 solenoid valve

The invention claimed is:

1. A scroll compressor comprising:

a shell configured as a hermetic container forming an enclosure;

a compression mechanism section provided in the shell and configured to compress refrigerant; and an injection pipe configured to inject the refrigerant to inside of the shell, the compression mechanism section including a stationary scroll and an orbiting scroll, the stationary scroll including a first base plate and a first wrap, the first wrap being provided to erect along an involute curve on one surface of the first base plate, the orbiting scroll including a second base plate and a second wrap, the second wrap being provided to erect along an involute curve on one surface of the second base plate, the first wrap having a winding angle larger than a winding angle of the second wrap, the first wrap and the second wrap being configured to form a plurality of compression chambers between the first wrap and the second wrap, each of the compression chambers having a volume smaller than volumes of compression chambers formed radially outward thereof, the compression chambers including at least a first compression chamber and a second compression chamber, the second compression chamber having a volume smaller than a volume of the first compression chamber, the first base plate being provided with a first injection port through which the refrigerant injected from the injection pipe into the shell passes in midway of being guided into the first compression chamber and a second injection port through which the refrigerant injected from the injection pipe into the shell passes in midway of being guided into the second compression chamber, and the second injection port being configured to provide an injection flow rate higher than an injection flow rate of the first injection port.

2. The scroll compressor of claim 1, wherein an area of the second injection port is larger than an area of the first injection port.

3. A The scroll compressor of claim 1, wherein the first compression chamber is an outermost chamber of the compression chambers formed between an inward surface of the first wrap and an outward surface of the second wrap, and the second compression chamber is an outermost chamber of the compression chambers formed between an outward surface of the first wrap and an inward surface of the second wrap.

4. The scroll compressor of claim 1, wherein, when a closing completion angle is 0 degrees, a rotation angle at which the first injection port is open is larger than a rotation angle at which the second injection port is open.

5. The scroll compressor of claim 1, wherein the first injection port has a length in a radial direction relative to a center of the stationary scroll, the second injection port has a length in the radial direction relative to the center of the stationary scroll, and the second wrap of the orbiting scroll has a thickness in the radial direction relative to the center of the stationary scroll, and the length of the first injection port and the length of the second injection port are both smaller than the thickness of the second wrap of the orbiting scroll.

6. The scroll compressor of claim 1, wherein a first gap extending in a height direction is formed between the first wrap and the second base plate, and a second gap extending in a height direction is formed between the second wrap and the first base plate, and a stationary scroll tip seal configured to seal the first gap is mounted at a tip of the first wrap, and an orbiting scroll tip seal configured to seal the second gap is mounted at a tip of the second wrap.

7. The scroll compressor of claim 6, wherein the orbiting scroll tip seal has a thickness in a radial direction relative to a center of the stationary scroll, the first injection port has a length in the radial direction relative to the center of the stationary scroll, and the second injection port has a length in the radial direction relative to the center of the stationary scroll, and the thickness of the orbiting scroll tip seal is larger than the length of the first injection port and the length of the second injection port.

8. The scroll compressor of claim 1, wherein the refrigerant is a single-component refrigerant expressed by a molecular formula: $C_3H_mF_n$, where m and n are integers of 1 or more and 5 or less and a relationship of m+n=6 establishes, and containing one double bond in a molecular structure, or a mixed refrigerant containing the single-component refrigerant.

9. The scroll compressor of claim 8, wherein the single-component refrigerant is 2,3,3,3-tetrafluoro-1-propene.

10. The scroll compressor of claim 8, wherein the mixed refrigerant includes difluoromethane.

11. The scroll compressor of claim 8, wherein the mixed refrigerant includes 1,1,2-trifluoroethene.

12. The scroll compressor of claim 1, wherein in a compression process, the refrigerant is injected simultaneously into the first compression chamber and into the second compression chamber.

13. A scroll compressor comprising:

a shell configured as a hermetic container forming an enclosure;

a compression mechanism section provided in the shell and configured to compress refrigerant; and an injection pipe configured to inject the refrigerant to inside of the shell, the compression mechanism section including a stationary scroll and an orbiting scroll, the stationary scroll including a first base plate and a first wrap, the first wrap being provided to erect along an involute curve on one surface of the first base plate, the orbiting scroll including a second base plate and a second wrap, the second wrap being provided to erect along an involute curve on one surface of the second base plate, the first wrap having a winding angle larger than a winding angle of the second wrap, the first wrap and the second wrap being configured to form a plurality of compression chambers between the first wrap and the second wrap, each of the compression chambers having a volume smaller than volumes of compression chambers formed radially outward thereof, the compression chambers including at least a first compression chamber and a second compression chamber, the second compression chamber having a volume smaller than a volume of the first compression chamber, the first base plate being provided with a first injection port through which the refrigerant injected from the injection pipe into the shell passes in midway of being guided into the first compression chamber and a second injection port through which the refrigerant injected from the injection pipe into the shell passes in midway of being guided into the second compression chamber, and the second injection port being configured to provide an injection flow rate higher than an injection flow rate of the first injection port, wherein the second injection port comprises a plurality of second injection ports, the first injection port comprises one or more first injection ports, and a number of the second injection ports is larger than a number of the first injection ports.

* * * * *